US005628456A

United States Patent [19]

Dupre

[11] Patent Number: 5,628,456

[45] Date of Patent: May 13, 1997

[54] BELOW SURFACE CONTROL SYSTEM FOR SNOW MAKING DEVICES

[76] Inventor: Herman K. Dupre, c/o Seven Springs, Champion, Pa. 15622

[21] Appl. No.: 534,837

[22] Filed: Sep. 27, 1995

[51] Int. Cl.[6] ..... F25C 3/04

[52] U.S. Cl. ..... 239/14.2

[58] Field of Search ..... 239/2.2, 14.1, 239/14.2, 201, 273, 276, 398, 407, 413, 414, 417.5, 578; 137/302, 607, 636

[56] References Cited

U.S. PATENT DOCUMENTS

| | | | |
|---|---|---|---|
| 3,814,319 | 6/1974 | Loomis | 239/2 S |
| 4,545,529 | 10/1985 | Tropeano et al. | 239/2 |
| 5,031,832 | 7/1991 | Ratnik et al. | 239/14.2 |
| 5,154,348 | 10/1992 | Ratnik et al. | 239/14 |
| 5,360,163 | 11/1994 | Dupre | 239/14 |

FOREIGN PATENT DOCUMENTS

| | | |
|---|---|---|
| 0479641A1 | 4/1992 | European Pat. Off. . |
| 2623276 | 5/1989 | France . |

*Primary Examiner*—Andres Kashnikow
*Assistant Examiner*—Robin O. Evans
*Attorney, Agent, or Firm*—Carothers & Carothers

[57] ABSTRACT

A snow making system wherein snow making devices, such as snow towers or snow guns, are distributed along a ski slope for producing man made snow with the supply of compressed air and water under pressure in subfreezing conditions. Valving for the supply of air and water to each snow making device is housed underground in a control pit enclosure with a removable access lid. The valves are ganged together for simultaneous operation by a single handle which is exposed through and above the lid for manual operation. The air and water connection hoses are also exposed through and above the lid for connection to an associated snow making device. The handle and these connection hoses are removable to present a flush nonhazardous ground surface in the off ski season. The valves are three-way valves which are adapted to drain all water from the associated snow making device when they are in the off condition in order to automatically drain the devices and protect them from freeze-up.

17 Claims, 1 Drawing Sheet

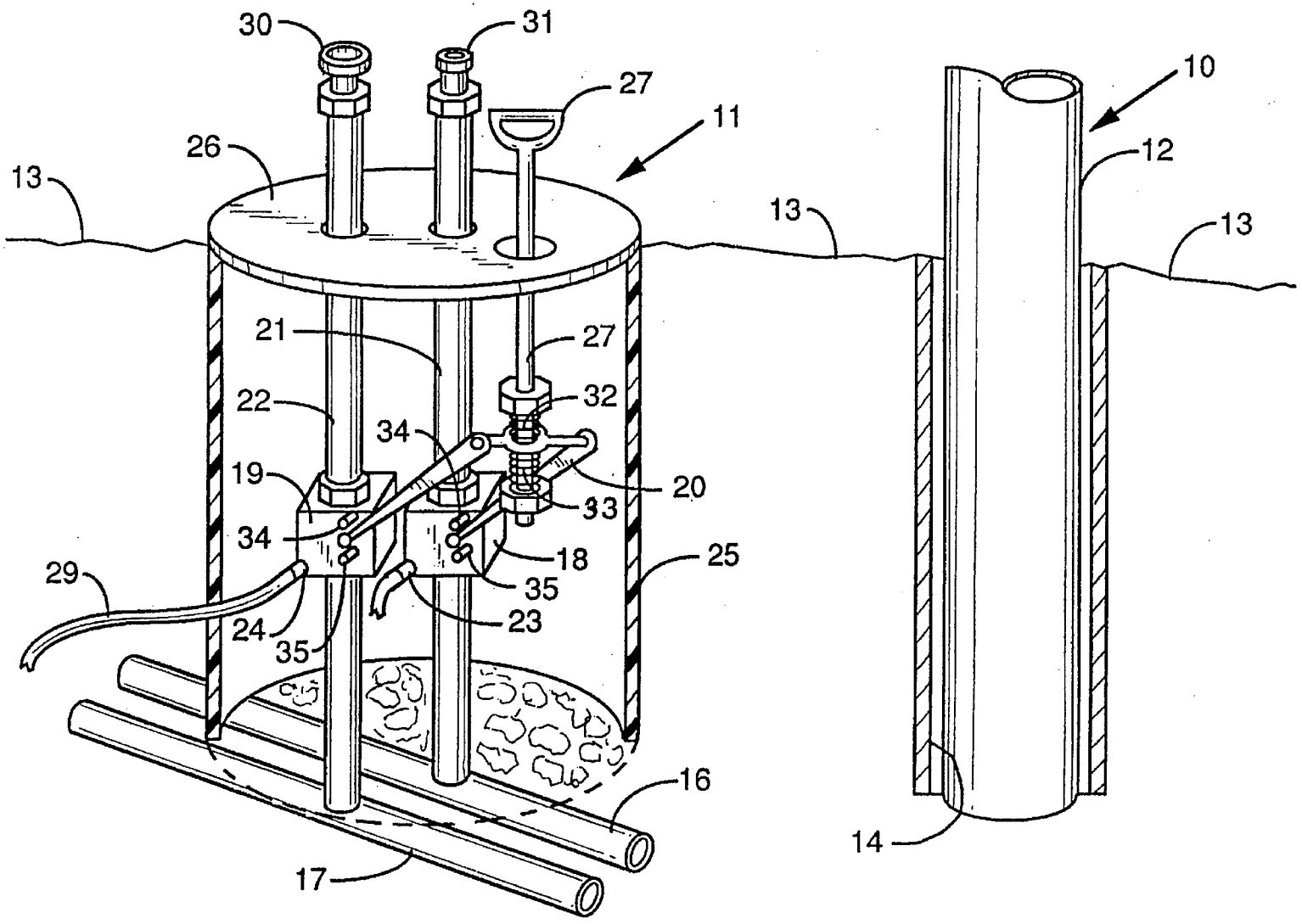
10
12
13
14
13
11
27
31
30
26
13
27
32
20
33
18
35
23
34
21
22
19
34
35
24
29
25
16
17

BELOW SURFACE CONTROL SYSTEM FOR SNOW MAKING DEVICES

BACKGROUND OF THE INVENTION

This invention relates to the art of making snow for ski resorts and the like. More particularly, it relates to improvements in apparatus utilized to control snow making devices for manufacturing snow for ski resorts.

It is well known that ski resorts utilize series of snow towers and/or snow guns on the ski slopes in order to manufacture snow with the combined use of water under pressure and compressed air in subfreezing conditions.

Ski resorts maintain crews of equipment operators whose job it is to travel the mountain sides to turn the snow making equipment on or off and to make other adjustments as required in order to maximize the manufacturer of man-made snow and to minimize waste of such manufactured snow. This requires the operator to move from snow making tower to tower or gun to gun in order to adjust or turn on and off the air and water valves supplying the respective snow making devices.

These exposed valves are generally mounted adjacent each snow tower on an air-water hydrant and are therefore subject to freezing and jamming due to freezing. They also present a year-around unwanted obstruction.

Additionally, the operator usually travels from tower to tower by snowmobile or an all-terrain vehicle and the setup at each tower is such that the operator is required to park and get off his vehicle, approach the tower and then free the water and air valves from snow and ice which is covering them and then manipulate each valve independently.

When there are many towers or snow guns on the ski slopes to maintain, this operation requires more than a considerable amount of the operator's time. In addition, the valves and/or lines may be found in a frozen condition and additional labor has to be expended in unfreezing the valve so that they can be manipulated.

Also, if the snow making device is being turned off, an additional drain valve must either be turned on or the water line actually disconnected from the hydrant to drain all water from the snow making device. Moisture can also accumulate in the air supply line and generally it must be also drained in order to prevent freeze-up in the supply lines from the hydrant to the snow making device. This all, of course, requires an unreasonable amount of expended labor which is costly.

In addition, when an operator disconnects the water and air supply lines which lead from the hydrant to the snow making device for draining the same when turning it off, the water and air supply lines can be easily mixed up and connected to the wrong supply upon reconnection and activation of the tower. The result is that the operator moves on and does not realize at the time that the snow making device is not operating correctly and that it is merely providing unwanted ice conditions on the ski slope.

Another major drawback of the snow making systems of the prior art for ski resorts is that in the off ski season when it is desired to use the ski slopes for other activities such as hiking or summer down-hill sports or activities, the hydrants of the prior art still protrude above ground as a hazardous condition as do the snow making towers or equipment itself. The hydrants are also expensive to manufacture.

It is a principal object of the present invention to provide a snow making system for ski resorts which in the off season leaves no objectional hazardous protrusions extending above the ski slope ground surface and provides a protected control system therefore which can be very easily and quickly attended to by an operator and prevents freeze-up of the valves and additionally automatically drains the snow making device when it is in an off condition.

SUMMARY OF THE INVENTION

The snow making system of the present invention includes a snow making device, such as a tower or gun, which is adapted to produce a spray of artificial snow from a combination of compressed air and water supplied from remote compressed air and water supplies. Air and water valves are connected between each snow making device and the supplies of compressed air and water for controlling the supply of air and water to the snow making device. These valves are enclosed in a control pit enclosure or housing below the ski slope ground surface. This enclosure or housing is provided with a removable access lid which is preferably flush with the ground surface to preclude unwanted hazardous projections above ground.

The enclosure has a bottom drain to drain off water and each set of air and water valves housed in the control pit enclosure are ganged for simultaneous valving of the air and water supply to the associated snow making device.

The air and water valves are also adapted for draining water from the connected snow making device when the valves are turned to their off position. This is accomplished by the use, for example, of conventional three-way valves so that when the valves are turned off to cut off the supply of compressed air and water under pressure to the snow making device, the three- way valves are opened otherwise to drain water from the air and water lines feeding the associated snow making device.

An improvement resides in the fact that a single handle is connected to simultaneously operate these ganged air and water valves and the handle is also exposed through and above the lid for manual manipulation above ground. This permits the operator to activate the snow tower without even getting off his snowmobile. He needs merely to drive up to the control box and locate the single handle and manipulate it to simultaneously activate both valves thereby cutting down the start-up or shutdown time to a mere ten seconds.

The operator does not have to get off his snowmobile to manipulate valves and he is not required to connect and disconnect hoses feeding the snow making device in order to drain water from the system when it is turned off.

Additionally the valves are insulated under ground and are prevented from freeze-up. Additional insulation may be provided in the control pit enclosure to assist in insulating the valves and piping within the enclosure. The bottom of the control pit is provided with drainage to prevent water accumulation.

Another feature of the present invention is that a drain conduit or hose is connected to the three-way water valve for draining off the water from the snow making device to a location outside the enclosure when the valves are turned to their off position. This prevents excessive accumulation of water within the control pit enclosure.

This air and water valve mechanism is the sole valving mechanism required to operate the respectively connected or associated snow towers or snow making devices. No additional valving is required at the base of the towers and no electrical connection is required for the driving of fans or for the operation of solenoid valves, which could readily fail in inclement weather.

The single handle which controls the ganged valves is removable so that in off ski seasons the handle may be quickly removed and dropped down into the control pit for storage during the summer to thereby preclude extension of the handle above ground, which could constitute a hazard.

Additionally the air and water connection hoses which connect the air and water valves respectively to an associated snow making device are also readily removable in the off season and can also be stored in the control pit so that no hazardous objects protrude above ground thereby making the surface safe for non-winter downhill activities.

Additionally these connection hoses are also preferably provided with above ground non-interchangeable couplings so that the respective connection of the air and water connection hoses to the snow making device cannot be inadvertently reversed by the operator.

The preferred type of snow making device to be used with the apparatus of the present invention is an adjustable snow making tower of the type designed by the present inventor and disclosed in U.S. Pat. No. 5,360,163.

It is also preferred that when such an adjustable snow making tower is incorporated with the control supply system of the present invention that the tower be removably embedded in the ski slope ground surface adjacent to the control pit. The snow tower can therefore be entirely removed from the ski slope in the off ski seasons to provide a ground surface that is completely without unwanted hazardous protrusions.

The below surface control system of the present invention is relatively inexpensive to construct and install, and reliable to operate as compared to the systems known in the prior art.

BRIEF DESCRIPTIONS OF THE DRAWINGS

Other objects and advantages appear in the following description and claims. The accompanying drawing shows, for the purpose of exemplification, without limiting the invention or claims thereto, certain practical embodiments illustrating the principals of this invention wherein the appended FIGURE is a perspective view in side elevation of the below surface control system of the present invention with portions thereof sectioned away to reveal interior contents.

DETAILED DESCRIPTION OF A PREFERRED EMBODIMENT

Referring to the drawing, a snow making system is illustrated wherein a snow making device in the form of a snow making tower 10 is illustrated in combination with an air and water control feed mechanism 11 which supplies the snow tower 10.

The snow making tower 10 is not shown in its entirety and only the base is illustrated. The snow making tower 10 is of the same type illustrated in Dupre U.S. Pat. No. 5,360,163, the only difference being that the base 12 of the tower 10, which is a support pipe for the tower, is removably embedded in the ski slope ground surface 13. The base 10 is received in a pipe lined pit 14 to retain the bottom end. The bottom of this pit 14 is provided with conventional drainage to drain off water accumulation and in the off ski season when the support 12 is removed from pit 14, a conventional metal or plastic cap (not shown) may be provided to cover over pit 14 to thereby prevent a hazard.

Compressed air and water under pressure are respectively provided from remote locations to snow tower 10 through underground lines 16 and 17. These lines continue on to other control pits 11 along the ski slope for supplying additional snow towers 10.

The supply of air and water to snow tower 10 from the respective air and water lines 16 and 17 is controlled respectively by three-way valves 18 and 19. These valves are ganged together by double operating arm 20 for simultaneous operation or valving of the air and water supply. Adjustable upper stops 34 and lower stops 35 are provided on the housings of valves 18 and 19 to limit the maximum arc of movement for operating arm 20 to prevent permanent damage to the valves.

Each of these three-way valves 18 and 19 is adapted for draining water from snow tower 10 through respective air and water connection hoses 21 and 22 by respective drains 23 and 24 when valves 18 and 19 are in their off position. Hoses 21 and 22 may extend as far as desired above lid 26 for connection to tower 10. Typical lengths of extension are 5 or 6 feet.

Valves 18 and 19 are housed in underground control pit enclosure 25 which is basically a plastic cylinder constructed of any suitable plastic, such as, polyurethane or polyvinyl chloride. Pit enclosure or housing 25 is also provided with a mating cap or lid 26 to close off the top. The bottom 26 is gravel for drainage to prevent water accumulation. The enclosure 25 may be filled with insulation such as rock wool to prevent freeze-up in valves and pipes.

A single control handle 27 is removably connected to control lever 20 to simultaneously operate valves 18 and 19 above ground by manipulation of the handle 27. Shock compression springs 32 and 33 are provided on opposite sides of lever 20 to prevent operation shock damage. When the handle 27 is in the up position as shown, the three-way valves 18 and 19 are on and water and air under pressure are being supplied through hoses 21 and 22 to snow tower 10. When the valves are off water drains out of air connection hose 21 through drain 23 and out of water connection hose 22 through drain 24. A drain hose 29 is connected to drain 24 for draining off the water to a location outside enclosure 25. This permits gravity drainage of all water (approximately 10 gallons) from tower 10 through connection hose 22 to an outside downhill location.

Handle 27 is exposed through and above lid 26 for manipulation and connection hoses 21 and 22 are also exposed through and above lid 26 for respective connection to snow tower 10.

The exposed air coupling 30 of connection hose 21 is a male coupler part and the exposed coupling 31 for water connection hose 22 is a female coupling part so that it is impossible for the operator to inadvertently reverse connection of the lines to snow tower 10. By using a male coupler 30 for the air line it has been found that the air coupling seal ring (not shown) is not inadvertently blown out on disconnect and lost. Also, couplings 30 and 31 may be located within enclosure 25 instead of above lid 26. The couplings 30 and 31 are conventional quick connect and disconnect couplings such as manufactured under the trademark Evertite.

In the spring, summer and fall seasons, or the off ski season, the handle 27 can be quickly disconnected from double lever mechanism 20 and dropped down into housing or enclosure 25 for storage until needed again in the winter. In a similar manner, hoses 21 and 22 can be readily unscrewed from the top of valves 18 and 19 and also stored in the pit during the off season.

In this situation, the top 26 remains on the enclosure 25 and presents a continuous above ground surface without hazardous protrusions projecting therefrom. Accordingly, when snow tower support 12 is removed and handle 27 and hoses 30 and 31 are removed, and snow tower support pit 14 is capped off, a nonhazardous ground surface is provided which is usable for summer downhill activities.

I claim:

1. In a snow making system including a snow making device adapted to produce a spray of artificial snow from a combination of compressed air and water supplied thereto from remote compressed air and water supplies, valve means operatively connected between said snow making device and the supplies of compressed air and water for controlling the supply of air and water to the snow making device, and control pit enclosure means adapted for enclosing said valve means below a ground surface with a removable access lid and bottom water drain means for draining off water, said valve means including air and water valves ganged for simultaneous valving of the air and water supply and said valves adapted for draining water from the connected snow making device when said valves are in their off position, the improvement comprising: a single handle connected to simultaneously operate said valves and exposed through and above said lid for manual manipulation, and drain conduit means connected to said water valve for draining off the water from the snow making device to a location outside said enclosure when said valves are in their off position.

2. The snow making system of claim 1 wherein said valve means is the sole valving mechanism for supply of air and water to said snow making device.

3. The snow making system of claim 1 wherein said handle is removable in off ski seasons to preclude extension thereof above ground.

4. The snow making system of claim 3 including air and water connection hoses respectively and removably connected to said air and water valves and exposed through and above said lid for connection to said snow making device.

5. The snow making system of claim 4 wherein said connection hoses are provided with above ground non-interchangeable couplings so that respective connection of said air and water connection hoses to said snow making device cannot be inadvertently reversed.

6. The snow making system of claim 4 wherein said snow making device is a snow making tower.

7. The snow making system of claim 6 wherein said snow making tower is removably imbedded in a ski slope ground surface for removal thereof in off ski seasons to provide a ground surface without unwanted hazardous protrusions.

8. A snow making system comprising:

(a) a plurality of snow making devices, each being adapted to produce a spray of artificial snow on a ski slope from a combination of compressed air and water supplied thereto from remote compressed air and water supplies;

(b) valve means operatively connected between each of said snow making devices and supplies of compressed air and water for controlling the supply of air and water to an associated snow making device;

(c) control pit enclosure means enclosing each of said valve means below a ground surface, and each enclosure means including a removable access lid exposed above ground and bottom water drain means for draining off water from said enclosure means;

(d) said valve means including water and air three-way valves with on and off positions and ganged for simultaneous valving of the air and water supply and said valves connected whereby each valve drains water from its connected snow making device when said valves are in the off position; and (e) a single handle connected to simultaneously operate said valves and exposed through and above said lid for manual manipulation;

(f) drain conduit means connected to said water valve for draining off the water from the associated snow making device to a location outside said enclosure.

9. The snow making system of claim 8 wherein said valve means is the sole valving mechanism for supply of air and water to said snow making device.

10. The snow making system of claim 8 wherein said handle is removable in off ski seasons to preclude extension thereof above ground.

11. The snow making system of claim 10 including air and water connection hoses respectively and removably connected to said air and water valves and exposed through and above said lid for connection to said snow making device.

12. The snow making system of claim 11 wherein said connection hoses are provided with above ground non-interchangeable couplings so that respective connection of said air and water connection hoses to said snow making device cannot be inadvertently reversed.

13. The snow making system of claim 12 wherein said snow making device is a snow making tower.

14. The snow making system of claim 13 wherein said snow making tower is removably imbedded in a ski slope ground surface for removal thereof in off ski seasons to provide a ground surface without unwanted hazardous protrusions.

15. The snow making system of claim 11 wherein said connection hoses are at least five feet long as required to couple with an associated one of said snow making devices.

16. The snow making system of claim 8 including spring shock absorber means connecting said handle to said valves for preventing shock damage to said valves when said single handle is manipulated.

17. The snow making system of claim 16 including stop means on said valves for limiting a maximum range of permissible movement of said handle to protect said valves from damage.

* * * * *